US007134230B1

(12) United States Patent
Boens et al.

(10) Patent No.: US 7,134,230 B1
(45) Date of Patent: Nov. 14, 2006

(54) STAND-UP DISPLAY

(75) Inventors: Gary Boens, Dayton, OH (US); Michael S. Kerth, Cincinnati, OH (US); Janet Reckers, Loveland, OH (US)

(73) Assignee: Innomark Communications, Fairfield, OH (US)

( * ) Notice: Subject to any disclaimer, the term of this patent is extended or adjusted under 35 U.S.C. 154(b) by 217 days.

(21) Appl. No.: 10/794,999

(22) Filed: Mar. 5, 2004

(51) Int. Cl.
*G09F 15/00* (2006.01)

(52) U.S. Cl. ..... 40/610; 40/124.07

(58) Field of Classification Search ..... 40/610, 40/124.07, 124.09, 124.14; 248/174, 459
See application file for complete search history.

(56) References Cited

U.S. PATENT DOCUMENTS

| | | | | | |
|---|---|---|---|---|---|
| 1,499,661 | A | * | 7/1924 | Hurst | 40/124.09 |
| 1,670,464 | A | * | 5/1928 | Marsh | 40/124.07 |
| 1,822,570 | A | * | 9/1931 | Einson | 40/539 |
| 2,113,288 | A | | 4/1938 | Berger | |
| 2,283,406 | A | * | 5/1942 | Bacon | 248/174 |
| 2,293,900 | A | | 8/1942 | Horr | |
| 2,312,644 | A | | 3/1943 | Horr | |
| 2,326,648 | A | * | 8/1943 | Horr | 312/140.2 |
| 2,851,804 | A | | 9/1958 | Roach | |
| 3,508,734 | A | | 4/1970 | Thomas | |
| 3,664,049 | A | | 5/1972 | Smith | |
| 3,727,874 | A | | 4/1973 | Wuensch | |
| 4,648,658 | A | * | 3/1987 | Calco | 297/440.12 |
| 4,753,341 | A | * | 6/1988 | McIntyre | 211/130.1 |
| 4,773,622 | A | | 9/1988 | Herlin | |
| 4,774,780 | A | | 10/1988 | Crowell | |
| 5,454,180 | A | | 10/1995 | Volpe | |
| 5,467,547 | A | | 11/1995 | Fortner | |
| 5,632,390 | A | | 5/1997 | Podergois | |
| 5,692,714 | A | | 12/1997 | Morrison | |
| 5,787,621 | A | * | 8/1998 | Leksell | 40/607.03 |
| 5,966,857 | A | * | 10/1999 | Pettersson et al. | 40/606.12 |
| 5,983,538 | A | | 11/1999 | Crowell | |
| 6,347,772 | B1 | | 2/2002 | L'Hotel | |
| 6,446,921 | B1 | * | 9/2002 | Maschhoff | 248/150 |
| 6,497,601 | B1 | | 12/2002 | Ward | |
| 6,508,023 | B1 | | 1/2003 | Moss et al. | |
| 2002/0104244 | A1 | | 8/2002 | Moss et al. | |

* cited by examiner

*Primary Examiner*—Joanne Silbermann
(74) *Attorney, Agent, or Firm*—Dinsmore & Shohl LLP

(57) ABSTRACT

A display that can be expanded from a collapsed position for storage and transport to an expanded position for free-standing operation and use. A spinal member is disposed between front and back panels such that in the collapsed position, the spinal member maintains the two panels substantially adjacent one another in a generally two-dimensional shape. Upon movement of at least a portion of the spinal member relative to the panels, parts of the spinal member bias the panels apart from one another to form an expanded, three-dimensional shape. This shape provides a sufficient footprint of the display relative to its height that the display can be free-standing. The cooperative relationship between the spinal member and the panels is such that no rubber bands or related elastic devices are required to maintain the display in the expanded position.

19 Claims, 7 Drawing Sheets

STAND-UP DISPLAY

BACKGROUND OF THE INVENTION

This invention relates generally to a stand-up display used for advertising and related retail functions, and more particularly to such a display that expands (i.e., pops out) from a generally planar two-dimensional shape into a three-dimensional shape with a minimal amount of human intervention.

The use of stand-up displays is commonplace in the modern retail environment. In such devices, a generally portable, lightweight display is placed to attract consumer attention to a particular good or service. Visual attributes, such as life-size pictures of a celebrity endorser or the like, entice a would-be consumer to consider purchasing the good or service advertised thereon. Similarly, such displays may also be used for public service or related non-commercial information. While such displays are effective vehicles for conveying a desired message, their physical dimensions (often measuring over two feet wide by more than five feet tall) make them unwieldy and expensive to transport. To that end, folding displays have been developed that can be stored and shinned in a compact, generally two-dimensional shape and that, upon expansion, assume a three-dimensional shape when in use. In such configurations, articulating flaps, expandable box-like members, elastic bands or combinations of the above can be used such that when the display reaches its destination, one or more people can assemble the display to ready it for its intended use.

The foldable displays have certain drawbacks, despite offering additional flexibility over their nonfoldable counterparts. The complex construction of the articulating parts of some displays are such that skilled assemblers are required, sometimes in teams of two or more. In either case, such complexity increases the cost associated with the display. Accordingly, there is a need to provide foldable, stand-up displays with simple construction so that a single unskilled installer can set up the displays quickly. In addition, many such displays employ numerous discrete parts that can become separated from the displays, making effective display construction more complicated. Accordingly, there is also a need to provide stand-up displays that reduce or eliminate the number of separable parts required for assembly of the displays. Moreover, the support structure used to give rigidity to present foldable displays is often located on the rear surface of the display. Such structure can detract from the appearance of the display, especially where the display is situated such that people can see both the front and rear surfaces. Furthermore, such structure takes up additional floor space. Accordingly, there is a need for a stand-up display that also keeps much, if not all, of the articulating componentry hidden from view.

SUMMARY OF THE INVENTION

These needs are met by the present invention, where a stand-up display is disclosed. According to a first aspect of the invention, a self-erecting display includes a front panel, a back panel facing the front panel and a spinal member disposed longitudinally between the front and back panels. In the present context, a display is self-erecting if it is constructed such that assembly of discrete components is not required to convert the display from a compact shape in which it has been stored or transported to its final as-displayed shape. In other words, if the display can be converted from its compact shape to its as-displayed shape by mere manipulation of the various display components such that the cooperative relationship between the components effects the conversion without recourse to separate assembly, then the display is self-erecting. In the present aspect, the relationship between the spinal member and the front and back panels is such that it defines a cooperative bias such that at least two positions exist. In a first position, the spinal member maintains the panels in a substantially collapsed relationship relative to one another. In this shape, inner surfaces of the two panels are substantially adjacent one another. In a second position, the spinal member urges (or forces) the front and back panels apart such that the display assumes a substantially three-dimensional use shape. Unlike prior art devices, the display of the present invention is able to maintain its three-dimensional use shape without recourse to a resilient device (such as a rubber band or similar elastic device that imparts a tension or traction force on the panels to bias the panels into a preferred, typically three-dimensional, orientation). As used in the present context, the term "substantially" refers to features that, while in theory would be expected to exhibit exact correspondence or behavior, may in practice embody something slightly less than exact. As such, the term denotes the degree by which a quantitative value, measurement or other related representation may vary from a stated reference without resulting in a change in the basic function of the subject matter at issue.

Optionally, the front panel, back panel and biasing spinal member are made of foldable paperboard, examples of which include cardboard and corrugated paper products. In addition, the front and back panels may each be subdivided into numerous panel sections, where longitudinally-spaced, horizontally extending fold lines can be used to define the various sections. Preferably, each of the fold lines in the front panel is substantially aligned with a corresponding fold line in the back panel so that, when the display is in the first position, the various panel sections can be folded over one another. This allows the display to assume a relatively compact, substantially two-dimensional shape that facilitates storage, transport or the like. In the present context, the terms "substantially two-dimensional" or "generally two-dimensional" are meant to represent the display in its folded-up shape, where the front and back panels are in a close, collapsed relation to one another, while the terms "substantially three-dimensional" or "generally three-dimensional" are meant to represent the display in its expanded shape. It will be appreciated that even though the substantially (or generally) two-dimensional shape has a three dimensional component, its small thickness dimension relative to that of the expanded (i.e., "three-dimensional") shape makes such terminology amply descriptive of the display configuration. As with the panels, the spinal member includes a plurality of longitudinally-spaced, horizontally extending fold lines located such that they are longitudinally aligned with the aforementioned fold lines that define the panel sections. This means that the substantially planar spinal member does not appreciably hamper the ability of the display to be folded into the substantially two-dimensional storage shape. Preferably, adhesive is used to couple the spinal member to the inner surfaces of one or both of the front and back panels. The coupling (whether by adhesive, fastener or other method) is such that upon movement of the spinal member relative to the front and back panels, the cooperative bias causes the display to change from one of the first or second positions to the other of the first or second positions. In yet another option, the spinal member is adhesively coupled to at least a majority of the panel sections to promote cooperative movement among as many of the panel sections as possible. In one preferred embodiment, the front and back panels together define a unitary (i.e., one-piece) construction. The placement of the front and back panels is such that a hollow chamber is formed between them. This hollow chamber is configured to conceal a substantial majority of the spinal member from outside view, thereby both improving the aesthetics of the display in its second position and permitting both the front and back panels to accept displayable indicia thereon, thus improving the effectiveness of the display.

In yet another option, the spinal member is made up of a first element configured as a pull tab and a second element cooperative with the pull tab. The second element includes a hinged spacer, a hinged affixing tab coupled to the spacer and a panel-engaging surface coupled to at least one of the display front or back panels. In one configuration, the panel-engaging surface is adhesively affixed to an inner surface of the back panel. The affixing tab can be coupled via adhesive to the first element such that at least the spacer is rotatably responsive to translational (i.e., linear, or back-and-forth) movement of the first element to effect the change between the first and second positions. In this way, the pulling or pushing movement of the pull tab along one linear dimension causes the spacer to rotate. The spacer, by virtue of its position relative to at least one of the front or back panels, pushes or pulls the corresponding front or back panel in a dimensional substantially orthogonal to the translational movement of the pull tab to effect the substantially two-dimensional or three-dimensional profile of the respective first or second position of the panels. The display may further include a foot support coupled to a lower end of the front and back panels. The foot support can be placed within one or both of the panels such that it is substantially coplanar with the panels in the first position, yet extends out in a substantially orthogonal direction to the surface of the panel from which it extends in the second position, thereby increasing the stability of the as-erected display. In one form, the foot support is integrally formed with the spinal member.

The display can further be configured to define a single transverse fold line so that rather than having a plurality of Z-fold panels, the display is divided into an upper half and a lower half that can be folded over one another. In addition, the display can define a substantially ogive-shaped planform, where the opposing panels can have convex outer surfaces that join at pointed ends. Moreover, the spinal member may be made from numerous plies of substantially planar material, where these plies include cutouts in the shape of a handle, a hinged spacer and a hinged affixing tab coupled to the spacer. As before, the spacer and affixing tab cooperate with one another as well as the surface of the panels to which they are attached to make the spacer rotatably responsive to translational movement of the spinal member, which in turn changes the shape of the display between the first and second positions. In a particular form, the various plies of the spinal member can all come from a single piece of material, thereby defining a unitary construction. An adhesive layer can be placed at one or more locations between the adjacent plies to promote adhesive bonding between them. By laminating the plies together, a stronger spinal member is formed.

According to another aspect of the invention, a stand-up display free of resilient support mechanisms includes a front panel, a spinal member, and a back panel. Both the front and back panels include inner and outer surfaces, where at least the outer surface is configured to accept displayable indicia. The inner surfaces of the front and back panels substantially face one another to define a chamber. The spinal member cooperates with the panels in such a way that the volume of space within the chamber is variable. In a first position, the spinal member maintains the variable volume chamber in a substantially collapsed (small volume) relationship, while in a second position the spinal member urges the substantially facing surfaces of the panels apart (larger volume) such that the display assumes a substantially three-dimensional use shape that is capable of free-standing (i.e., without the need for additional support structure) operation.

Optionally, the spinal member is made up of a first element and a second element. The first element is equipped with a graspable proximal end situated adjacent a top end of the panel, and a distal end substantially opposite the proximal end. In the present context, the top end of the display is that end which is highest when the display is in its free-standing condition. The second element includes a hinged spacer, a hinged affixing tab coupled to the spacer and a panel-engaging surface coupled to at least one of the front or back panels. The affixing tab is adhesively connected at discrete locations along the length of the first element such that at least the spacer is rotatably responsive to translational movement of the first element. As discussed in conjunction with the previous aspect, this effects the change of the display between the first and second positions. In addition, the front panel, back panel and spinal member are optionally made of foldable paperboard.

According to yet another aspect of the invention, a method of displaying visual information is disclosed. The method comprises the steps of configuring a self-erecting display to include a first end and a second end, and as with the previous aspects of the invention, the display includes a front panel, a back panel facing the front panel and a spinal member disposed longitudinally between the front and back panels to define a cooperative bias between them. As with the previous aspects of the invention, while in a first position, the spinal member maintains the panels in a substantially collapsed relationship relative to one another, while in a second position the spinal member urges the front and back panels apart such that the display assumes a substantially three-dimensional use shape without recourse to a resilient device for effecting such shape. Additional steps include placing displayable indicia on at least one of the front or back panels, pulling on the spinal member such that the display expands from the collapsed relationship of the first position to the three-dimensional use shape of the second position, and placing the display on a display-supporting surface such that the display is capable of free-standing operation.

Optionally, the step of configuring the display further comprises placing a plurality of longitudinally-spaced, horizontally extending fold lines in the front and back panels such that each of the fold lines in the front panel is substantially aligned with a corresponding fold line in the back panel to define a plurality of panel sections in the display. These panel sections can be folded over one another to define a relatively compact (including substantially two-dimensional) shape to facilitate transport or storage. An additional step can include moving the first end substantially vertically upward relative to the second end such that the panel sections become longitudinally unfolded and the display assumes an extended length. As with the previous embodiment, the spinal member includes a first element, configured as a pull tab, and a second element comprising a panel-engaging surface coupled to at least one of the front or back panels. The panel-engaging surface is made up of a hinged spacer and a hinged affixing tab coupled to the spacer in a manner previously discussed. Also as previously discussed, the front and back panels can be formed from a unitary piece of material, such as foldable paperboard, plastic or the like.

DETAILED DESCRIPTION OF THE PREFERRED EMBODIMENTS

Figure 1:
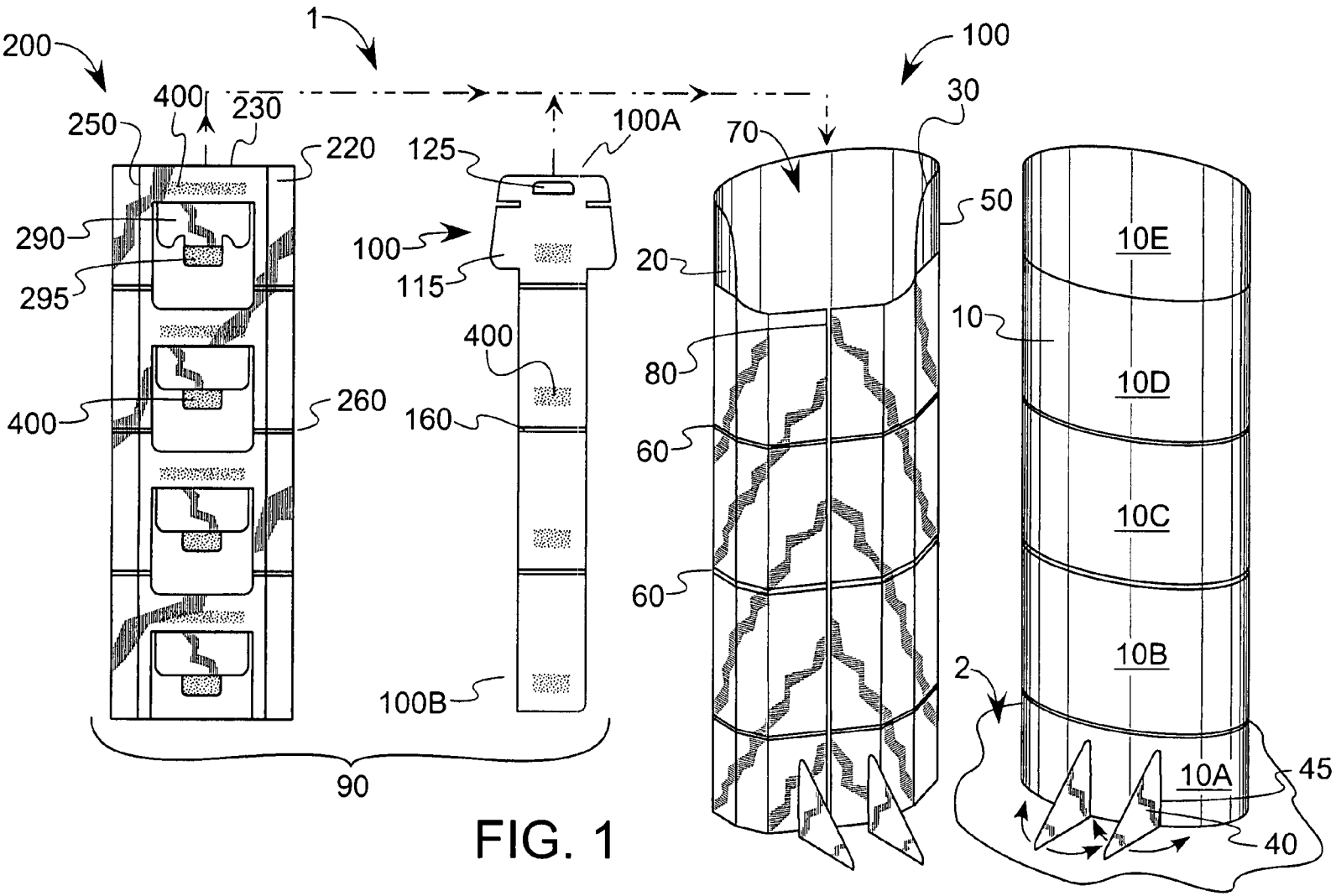
FIG. 1 shows a display according to an aspect of the invention in a free-standing operational condition, including a two-part spinal member that fits inside a hollow central chamber of the display.
Figure 2:
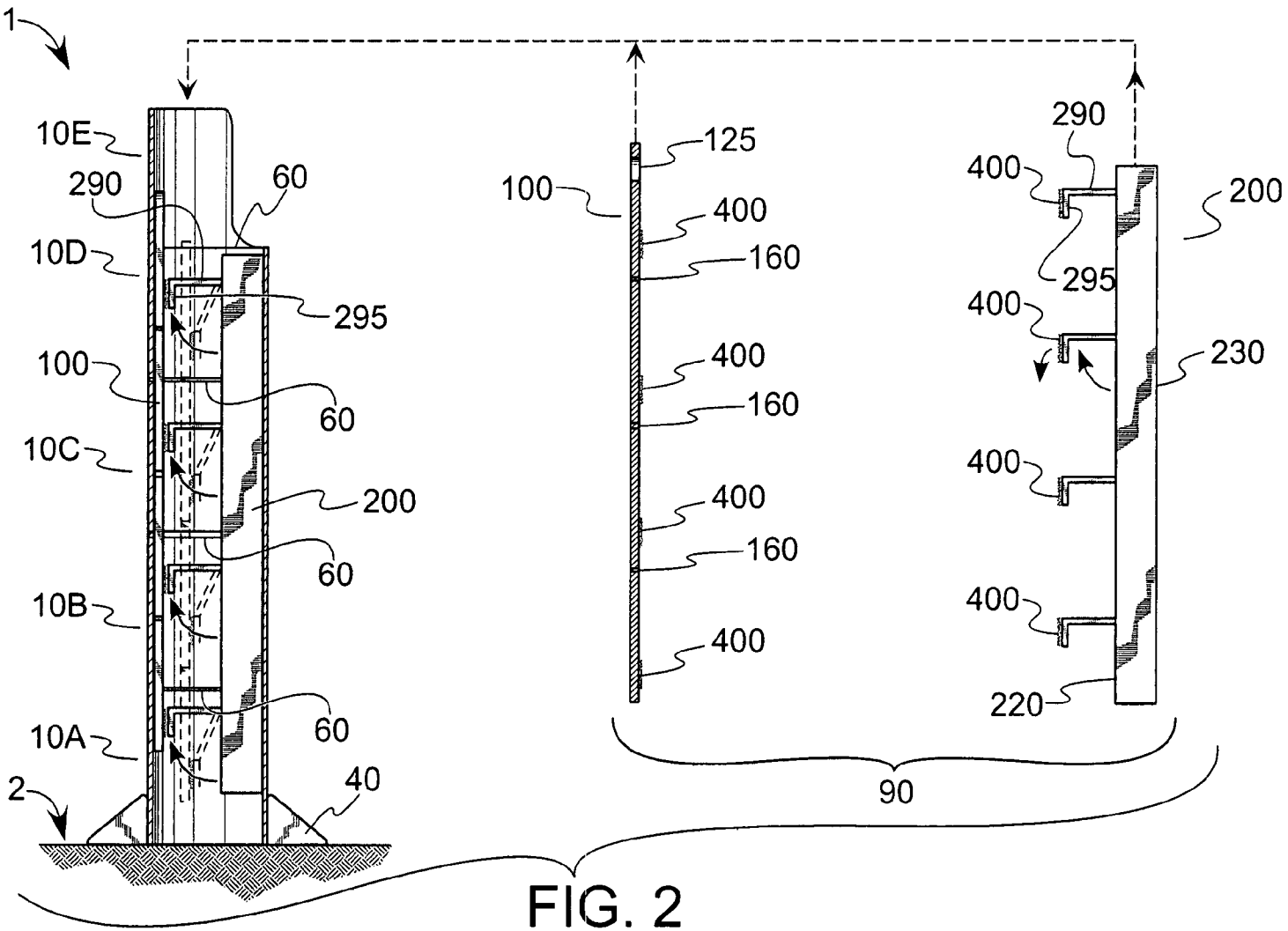
FIG. 2 shows a side view of the display and spinal member components of FIG. 1.

Referring first to FIGS. 1 and 2, front and side views respectively of an embodiment of the invention are shown, where a stand-up display 1 includes a front panel 10, a back panel 30 and an internal spinal member 90. During periods of use (i.e., display), optional feet 40 can be provided, extending in a generally horizontal direction from front and back panels 10, 30 to stabilize display 1 further. Although the display 1 is configured for free-standing operation without the need for the feet 40, there are situations where the use of feet 40 may be beneficial. For example, in areas where display 1 could be exposed to significant airflow (such as adjacent a heating, ventilating and air conditioning (HVAC) duct, or near a door or window), feet 40 can provide additional resistance to tipping. Longitudinal fold lines 50 are included to give rear panels 30 a faceted structure 20, while transverse (longitudinally-spaced) fold lines 60 are formed in the front, side and back panels to allow display 1 to be folded into a relatively compact, substantially two-dimensional shape for storage or shipping. For example, the display 1 can be Z-folded while in its two-dimensional shape. Each of the panels 10 and 30 have both external (outwardly-facing) surfaces and internal (inwardly-facing) surfaces. An internal chamber 70 is bounded by the various internal surfaces of panels 10 and 30. Seam 80 is longitudinally formed by placing opposing edges of the rear panels 30 adjacent one another.

The spinal member 90 is disposed between the front and back faces 10, 30 and is expandable such that upon translational articulation of the spinal member 90 along its longitudinal axis, the display 1 expands from a generally planar two-dimensional shape into a three-dimensional shape with a minimal amount of human intervention. In this three-dimensional shape, the front panel 10 becomes outwardly bowed to take on a convex shape, while the back panel 30 is faceted along the longitudinal fold lines 50. The spinal member 90 is made up of two components, including a first element 100 and a second element 200. The first element 100 includes a proximal end 100A of extended width that terminates in a pull tab 115 with handle 125. A trunk extends from the proximal end 100A to the distal end 100B, and is more narrow than the pull tab 115 of proximal end 100A. Spaced along the trunk are numerous fold lines 160 that are designed to align with fold lines 60 of front and back panels 10 and 30 such that, upon folding of the display 1 into its more compact storage shape (shown and described later), the fold lines 160 will not appreciably increase the resistance of the display 1 to folding. Adhesive-accepting regions 400 are periodically defined along the length of first element 100, and can either have adhesive disposed directly thereon, or can be mated to a corresponding region on second element 200, as will be described next.

Second element 200 forms the part of spinal member 90 that is affixed to at least one of the panels 10, 30. In the configuration shown, central surface 230 of second element 200 can be adhesively affixed to the internal surface of back panel 30, although it will be appreciated that other affixing schemes and locations may be suitably adopted. Faceted surfaces 220 can be defined by a longitudinal fold line 250 to enable the second element to better fit against the corresponding surface of back panel 30. The faceted surfaces may additionally be adhesively or otherwise affixed to the corresponding faceted structure 20 of back panel 30. Once the second element 200 of spinal member 90 is affixed to back panel 30, the spacing of seam 80 between the opposing edges of back panel 30 becomes relatively fixed such that the opposing edges (and consequently the opposing sides of back panel 30) cannot move toward one another. While the opposing lateral edges of the front panel 10 bow toward each other when the display expands from its two-dimensional shape to its three-dimensional shape, it will be appreciated that such movement is more in the nature of a hinged movement rather than a translational motion. As with first element 100, second element 200 includes a plurality of longitudinally-spaced fold lines 260 that are sized and spaced to cooperate with fold lines 60 of the front and back panels 10, 30. As shown in FIG. 1, second element 200 has adhesive-accepting regions 400 that are periodically defined along its length; as with the fold lines 260, these adhesive-accepting regions 400 are aligned with the corresponding adhesive-accepting regions 400 of first element 100. It will be appreciated that adhesive can be disposed on either or both surfaces to secure the first and second elements 100, 200 together at select locations.

Second element 200 additionally includes a plurality of longitudinally-spaced hinged spacers 290 that are formed from cutouts in central surface 230. The hinged connection is a result of leaving a substantially horizontal continuous section between the proximal end of spacer 290 and the remainder of central section 230. Fold lines can also be included along the substantially horizontal continuous section to facilitate the hinged relationship. An affixing tab 295 is disposed at the distal end of spacer 290 and is further hinged along a substantially horizontal continuous section between them. As with the hinge formed between the central section 230 and the spacer 290, fold lines can also be included along the substantially horizontal continuous section to facilitate the hinged relationship. Referring with particularity to the side view of FIG. 2, details of how the first and second elements 100, 200 fit together, as well as how they fit between front and back panels 10, 30, are shown. Rotating arrows indicate hinged motion of both spacer 290 and the affixing tab 295, while the vertically translating arrow near the top of the display 1 shows the intended motion of the spinal member 90 when grasped and pulled along handle 125.

As can be seen in the side view of FIG. 2, the front and back panels 10, 30 significantly envelop the spinal member 90, such that little or none of it is exposed to a viewer when the display 1 is viewed in its free-standing (upright) use position. Not only is this feature more aesthetically pleasing than prior art devices where the spinal member and related biasing components are exposed, but this feature also avoids possible snagging or entanglement of the cooperating parts of the spinal member 90 and panels 10, 30 as they articulate. In addition, the display 1 of the present invention contains no rubber band or related elastic bias-producing components, achieving its three-dimensional shape solely from the pushing action of the rigid spinal member 90 on the deformable front and back panels 10, 30. In the configuration shown, all of the front panel 10, back panel 30 and spinal member 90 are formed from rigid material (such as corrugated or related paperboard product) that is selectively adhered at locations 30A, 30B, 30C to the inner surfaces 10A, 20A of the front and back faces 10, 20 to force cooperative movement therebetween.

Figure 3B:
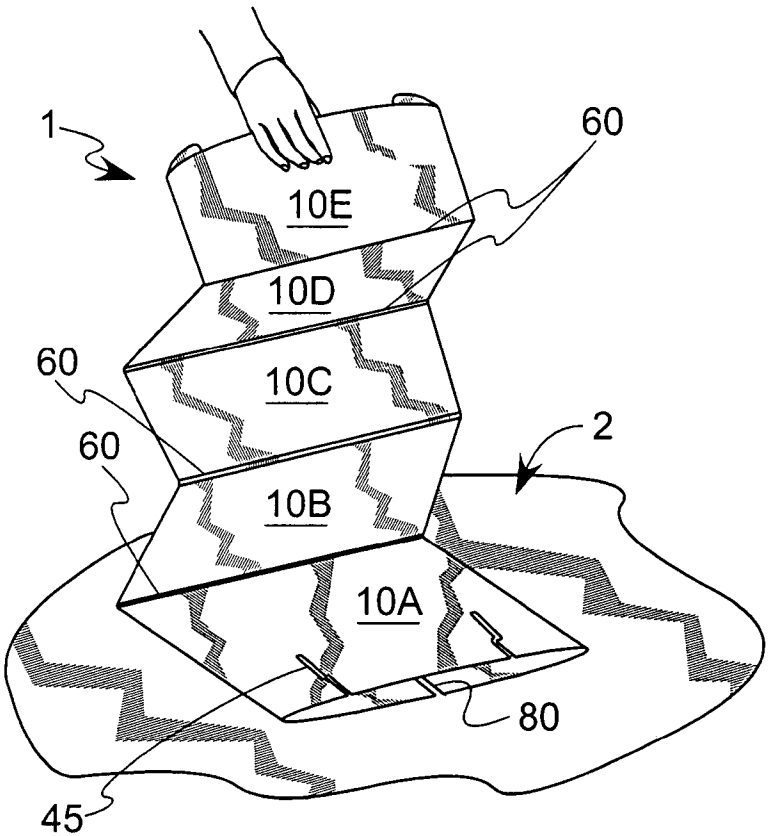
FIG. 3B shows grasping the display of FIG. 3A along its first (i.e., top) end so that it can be picked up and allowed to unfold.
Figure 3A:
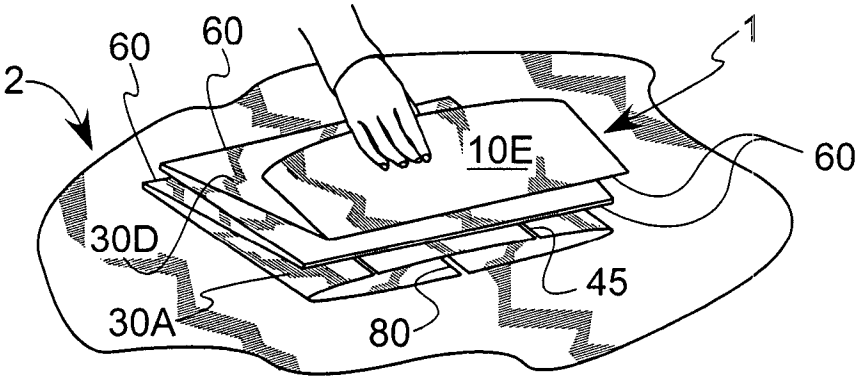
FIG. 3A shows placing the display of FIG. 1 on a planar display surface in its folded, substantially two-dimensional storage shape.
Figure 3C:
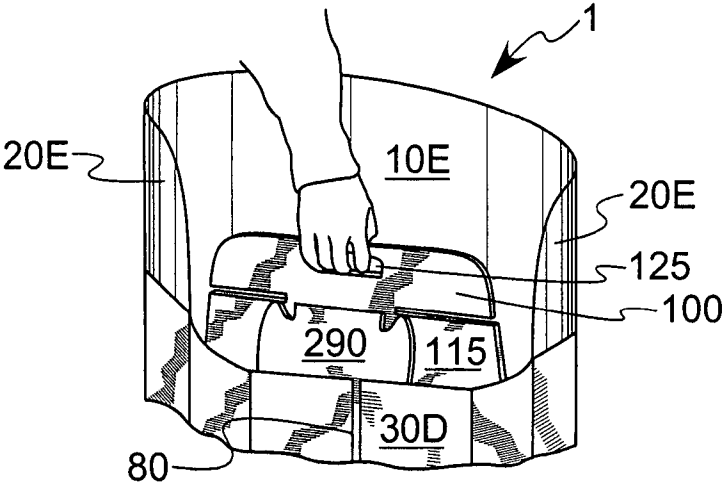
FIG. 3C shows grasping the spinal member disposed adjacent the first end of the display of FIG. 3B and pulling the spinal member translationally relative to the display panels to force the display into its expanded second position.

Referring next to FIGS. 3A through 3C, the steps taken to erect display 1 on a substantially planar level display surface 2 are shown. Referring with particularity to FIG. 3A, the display 1, in its substantially two-dimensional, folded-up state, is shown being placed on display surface 2 such that the uppermost panel section 10E is facing upward. The user grasps uppermost panel section 10E and pulls it up vertically, thereby causing the display 1 to unfold, as shown in FIG. 3B. During this step, the display 1 is still in a first position, such that the spinal member 30 (not presently shown) has not caused the rotation of spacer 290 relative to the front and back faces 10, 20, thereby leaving display 1 in its substantially two-dimensional, planar form. Referring next to FIG. 3C, the step of expanding display 1 from its previous first position to its second position (where it assumes its use shape, also referred to as its as-displayed shape) is shown. Upon the user grasping handle 125 and pulling up pull tab 115 of first element 100, the hinged spacer 290 rotates out of the plane of second element 200 such that it extends orthogonally relative to the plane, causing the panels 10, 30 of the display 1 to expand outward. As a result, display 1 assumes a more three-dimensional shape, thereby allowing the display 1 to stand upright on generally planar surface 2. In this three-dimensional shape, the front panel 10 becomes outwardly bowed to take on a convex shape, while the facets 20 of rear panel 30 form along predetermined longitudinal fold lines 50. As previously mentioned, the display 1 achieves its three-dimensional shape solely from the pushing action of the spinal member 90 against the deformable front and back faces 10, 30 without recourse to elastic bands or related paraphernalia.

Figure 4:
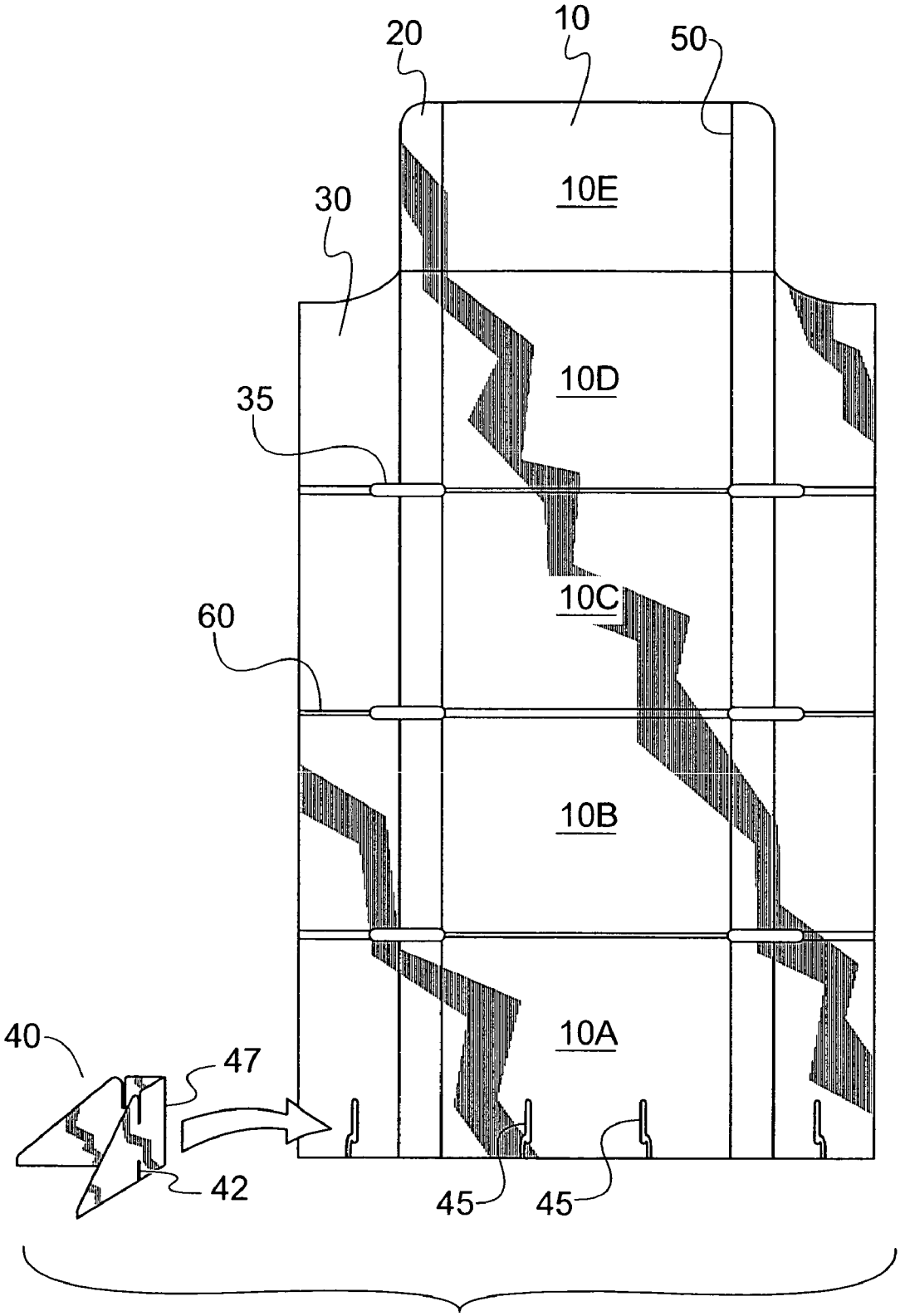
FIG. 4 shows a view of a unitary piece of material making up the front and back panels of the display of FIG. 1.
Figure 5:
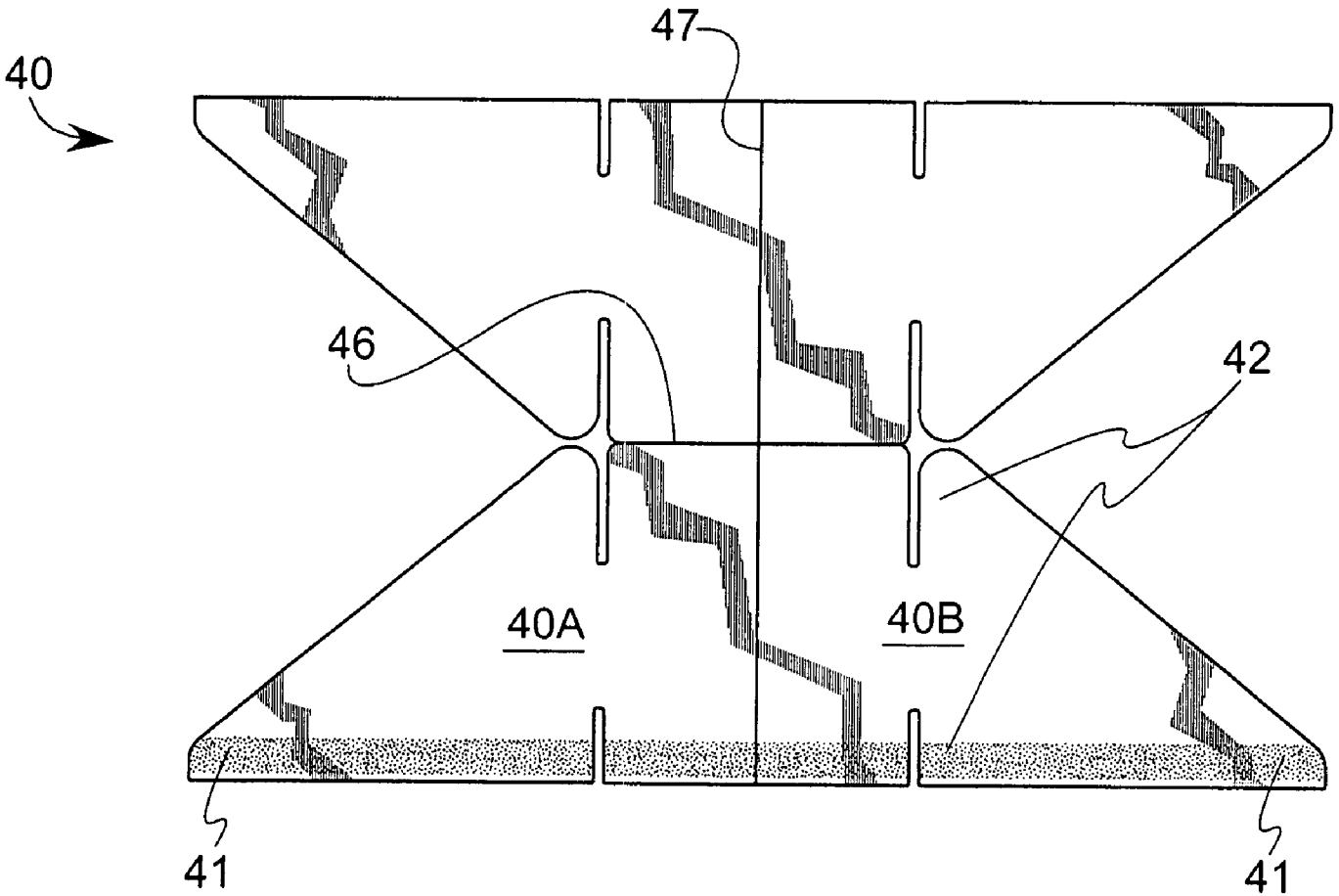
FIG. 5 shows a construction of optional feet that can be added to the lower (base) section of the display.

Referring next to FIGS. 4 and 5, cutouts corresponding to the front and back panels 10, 30 and the foot support 40 are shown. Referring with particularity to FIG. 4, it can be seen that the front and back panels 10, 30 are formed out of a unitary piece of material. In addition, longitudinal fold lines 50 and horizontal fold lines 60 can be formed by creasing the material, where horizontal fold lines 60 can be of differing widths, depending on the number of panel sections that need to be folded into the space defined by the panel sections adjacent each fold line 60. Cutouts 35 can be formed along portions of the fold lines 60 of the back panel 30, especially along the thicker fold lines, to accommodate folding operations better. Not only does this facilitate folding display 1 into its substantially two-dimensional shape, the removal of material along the hinge reduces the likelihood of unsightly tears or crimping. Additional cutouts 45 placed along the lower end of front and back panels 10, 30 can accept complementary cutouts 42 in support feet 40, one of which is shown as a foldable part that upon folding along fold line 46 defines a relatively rigid support. Fold line 47 allows the lateral sides 40A, 40B to be folded over one another such that cutouts 42 are aligned. While the support feet 40 are in a mostly folded-over state (as shown in FIG. 4) and the display 1 is in its substantially two-dimensional shape, the feet 40 can be placed in cutouts 45 in such a way that free ends 41 of feet 40 extend laterally toward the outer edges of front and back panels 10, 30. Upon expansion of display 1 into its substantially three-dimensional shape, cooperation between cutouts 45 and the cutouts 42 of feet 40 cause feet 40 to unfold, thereby forcing free ends 41 to extend as far apart from one another as possible in a direction generally orthogonal to the front and back panels 10, 30.

Figure 6A:
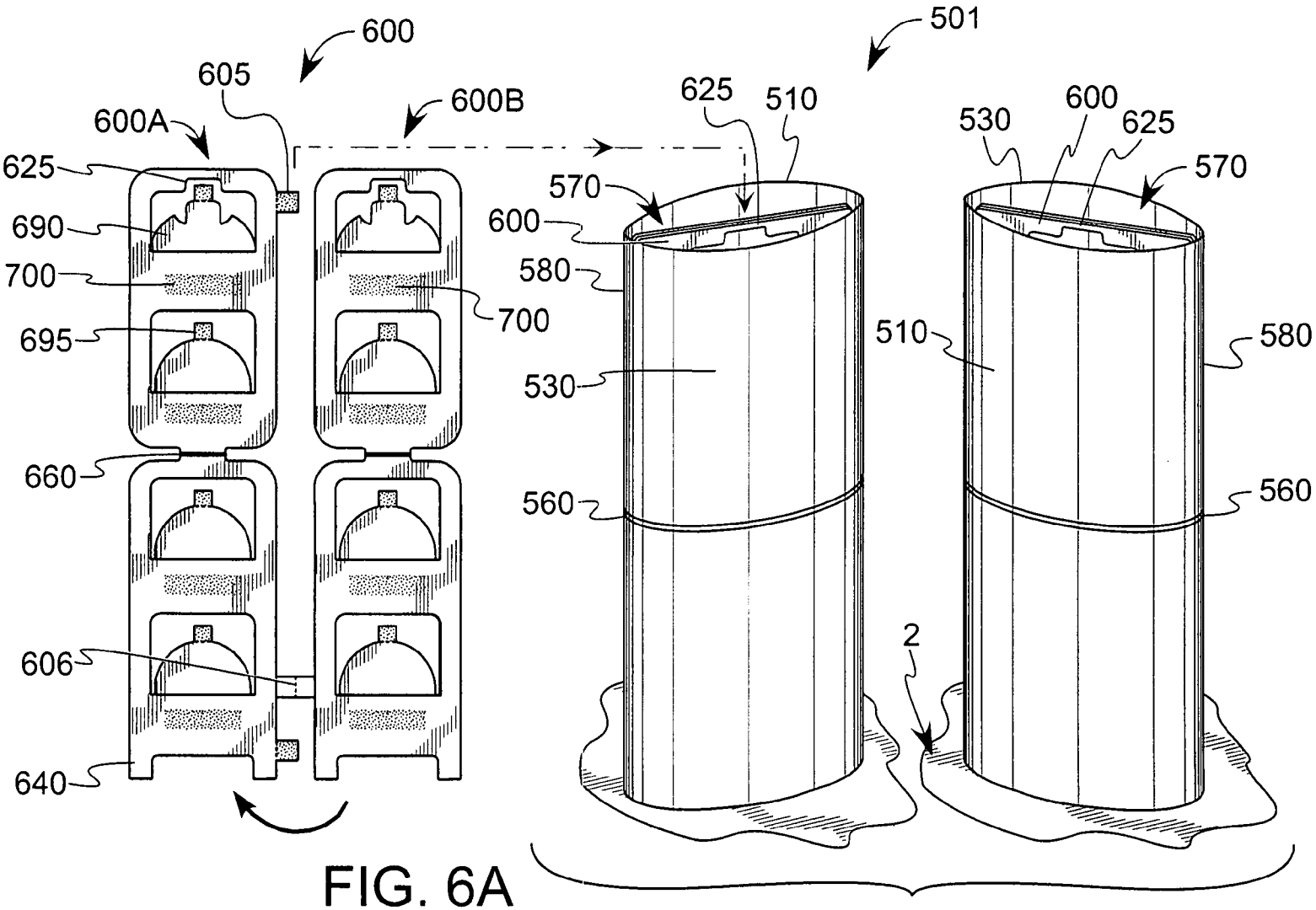
FIG. 6A shows a display according to another aspect of the invention in a free-standing operational condition, including a one-part spinal member and a non-faceted, ogive-shaped display.
Figure 6B:
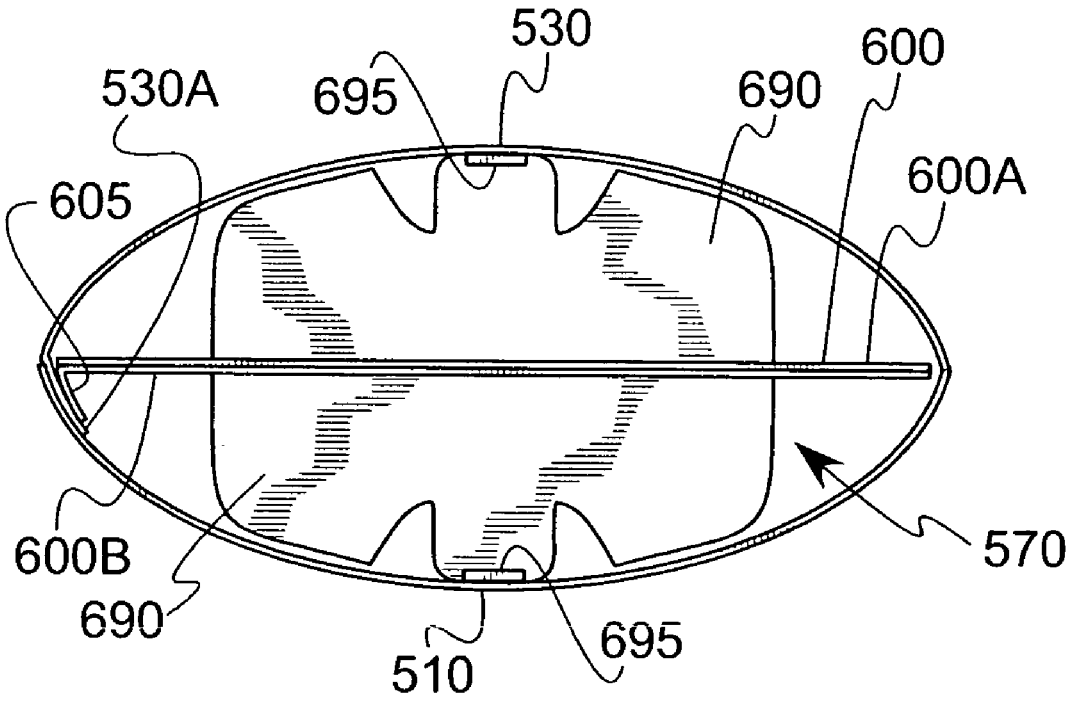
FIG. 6B shows a top (planform) view of the display of FIG. 6A.

Referring next to FIGS. 6A and 6B, an alternate embodiment of the invention is shown, where a stand-up display 501 includes a front panel 510, a back panel 530 and an internal spinal member 600. Unlike the optional feet 40 shown in FIG. 1, optional feet 640 can form an integral part of spinal member 600. Also unlike the embodiment depicted on FIG. 1, there are no longitudinal fold lines, as the front and back panels 510, 530 each form a smooth, facet-free surface, and where a tab-like flap 530A can be used to overlap the front and back panels 510, 530, and where an adhesive (not shown) can be placed between flap 530A and a corresponding surface on the inward-facing side of front panel 510. Referring with particularity to FIG. 6B, the planform view shows that the three-dimensional shape formed by the display 501 when erected is substantially in the shape of an ogive. A transverse (longitudinally-spaced) fold line 560 is formed about half-way up the in the front and back panels 510, 530 to allow display 501 to be folded into a relatively compact, substantially two-dimensional shape for storage or shipping. In further contrast to the embodiment shown in FIG. 1, seam 580 (which is formed from overlapping portions of the front and back panels 510, 530 is now situated along one of the points of the ogive.

The spinal member 600 performs a similar function to that of spinal member 90 depicted in FIG. 1; however, whereas spinal member 90 of the earlier embodiment is of two-piece construction (made up of first element 100 and second element 200), the present spinal member 600 combines these disparate features, now formed from a single piece of material with adjacent panels 600A and 600B that can be folded over onto one another and secured through adhesive, velcro or related means. Cut-outs formed in predetermined locations define lateral tabs 605 that can be secured to the inner surface of one or both of the front and back panels 510, 530, as well as a handle 625, spacer 690 and affixing tab 695. As with the previous embodiment of FIG. 1, spacer 690 is used to expand the display 501 into its substantially three-dimensional shape when handle 625 is pulled along the substantially longitudinal axis of the display 501. Similarly, affixing tab 695 is used keep the spacer 690 anchored relative to the inner surface of one of the front and back panels 510, 530 through adhesive or related attachment schemes. Adhesive can be placed on affixing tab 695 so that upon construction of display 501, affixing tab 695 can be secured to one of the inner surfaces. Transverse fold line 660 is sized and spaced to coincide with transverse fold line 560 formed on the front and back panels 510, 530. Interconnecting tab 606 keeps the adjacent panels 600A and 600B spaced relative to one another prior to folding. By folding along a substantially longitudinal axis of the spinal member 600, the adjacent panels 600A and 600B can be made to form a two-ply laminate, where adhesive-accepting regions 700 can be coated with adhesive to facilitate permanent bonding of the adjacent panels 600A and 600B. This two-ply configuration is particularly robust, lending additional resistance to tearing of spinal member 600. As with the previous embodiment, when handle 625 is grasped and spinal member 600 is pulled relative to the front and back panels 510, 530, the spacers 690 deploy, causing front panel 510 becomes outwardly bowed to take on a convex shape; unlike the previous embodiment, the back panel 530 also takes on a convex shape, giving the overall ogive shape shown in FIG. 6B.

Having described the invention in detail and by reference to preferred embodiments thereof, it will be apparent that modifications and variations are possible without departing from the scope of the invention defined in the appended claims.

What is claimed is:

1. A self-erecting display comprising:

a front panel;

a back panel facing said front panel; and a spinal member disposed longitudinally between said front and back panels to define a cooperative bias therebetween such that in a first position said spinal member maintains said panels in a substantially collapsed relationship relative to one another, while in a second position said spinal member urges said front and back panels apart such that said display assumes a substantially three-dimensional use shape without recourse to a resilient device for effecting said three-dimensional use shape, said spinal member comprising a first element configured as a pull tab, and a second element comprising a panel-engaging surface coupled to at least one of said front or back panels, said panel-engaging surface comprising a hinged spacer and a hinged affixing tab coupled to said spacer, said affixing tab affixed to said first element such that at least said spacer is rotatable responsive to translational movement of said first element to effect said change of said display between said first and second positions.

2. The display of claim 1, wherein said front panel, back panel and spinal member are made of foldable paperboard.

3. The display according to claim 1, wherein said front and back panels each further comprise a plurality of longitudinally-spaced, horizontally extending fold lines such that each of said fold lines in said front panel is substantially aligned with a corresponding fold line in said back panel to define a plurality of panel sections that, when said display is in said first position, can be folded over one another such that said display assumes a generally two-dimensional storage shape.

4. The display according to claim 3, further comprising:

a plurality of longitudinally-spaced, horizontally extending fold lines disposed in said spinal member and located such that they are longitudinally aligned with said plurality of longitudinally-spaced, horizontally extending fold lines defining said panel sections such that said spinal member does not appreciably hamper the ability of said display to be folded into said generally two-dimensional storage shape; and an adhesive layer disposed between at least portions of said spinal member and inner surfaces of at least one of said front and back panels to affix said spinal member thereto such that upon translational movement of at least a portion of said spinal member relative to said front and back panels, said cooperative bias causes said display to change from one of said first or second positions to the other of said first or second positions.

5. The display according to claim 1, wherein said spinal member is adhesively coupled to at least one of said front and back panels.

6. The display according to claim 1, wherein said front and back panels together define a unitary construction.

7. The display according to claim 6, wherein said front and back panels are disposed relative to one another such that a hollow chamber is formed therebetween, said hollow chamber configured to conceal a substantial majority of said spinal member from outside view, thereby permitting both panels to accept displayable indicia thereon.

8. The display according to claim 1, wherein said panel-engaging surface is adhesively affixed to an inner surface of said back panel.

9. The display according to claim 1, further comprising a foot support coupled to a lower end of said front and back panels.

10. The display according to claim 9, wherein said foot support is integrally formed with said spinal member.

11. The display according to claim 1, wherein said substantially three-dimensional shape defines a substantially ogive-shaped planform.

12. A stand-up display free of resilient support mechanisms, said display comprising:

a front panel defining an inner surface and an outer surface, at least said outer surface configured to accept displayable indicia thereon;

a spinal member comprising:

a first element comprising a graspable proximal end and a distal end substantially opposite said proximal end; and a second element defining at least one panel-engaging surface thereon, said second element comprising a hinged spacer and a hinged affixing tab coupled to said spacer, said affixing tab affixed at discrete locations along the length of said first element such that at least said spacer is rotatably responsive to translational movement of said first element; and a back panel defining an inner surface and an outer surface such that said inner surfaces of said front and back panels substantially face one another to define a variable volume chamber therebetween, at least a portion of said chamber affixed to said spinal member such that in a first position, said spinal member maintains said chamber in a substantially collapsed relationship, while in a second position said spinal member urges said substantially facing surfaces of said chamber apart such that said display assumes a three-dimensional use shape that is capable of free-standing operation.

13. The display of claim 12, wherein said front panel, back panel and spinal member are made of foldable paperboard.

14. A method of displaying visual information, said method comprising:

configuring a self-erecting display to comprise a first end and a second end, said display comprising:

a front panel;

a back panel facing said front panel; and a spinal member disposed longitudinally between said front and back panels to define a cooperative bias therebetween such that in a first position said spinal member maintains said panels in a substantially collapsed relationship relative to one another, while in a second position said spinal member urges said front and back panels apart such that said display assumes a generally three-dimensional use shape without recourse to a resilient device for effecting said three-dimensional use shape, said spinal member comprising a first element configured as a pull tab and a second element comprising a panel-engaging surface coupled to at least one of said front or back panels, said panel-engaging surface comprising a hinged spacer and a hinged affixing tab coupled to said spacer, said affixing tab adhesively affixed to said first element such that at least said spacer is rotatably responsive to translational movement of said first element to effect said change of said display between said first and second positions;

placing displayable indicia on at least one of said front or back panels;

pulling on said spinal member such that said display expands from said collapsed relationship of said first position to said three-dimensional use shape of said second position; and placing said display on a display-supporting surface such that said display is capable of free-standing operation.

15. The method according to claim 14, wherein said configuring said display further comprises placing a plurality of longitudinally-spaced, horizontally extending fold lines in said front and back panels such that each of said fold lines in said front panel is substantially aligned with a corresponding fold line in said back panel to define a plurality of panel sections in said display.

16. The method of claim 15, further comprising moving said first end substantially vertically upward relative to said second end such that said panel sections are longitudinally unfolded so that said display assumes an extended length prior to said pulling on said spinal member.

17. The method according to claim 14, wherein said configuring said display further comprises forming said front and back panels from a unitary piece of material.

18. The method according to claim 17, wherein said unitary piece of material is foldable paperboard.

19. The method according to claim 17, wherein said pulling said spinal member causes said generally three-dimensional shape to assume a substantially ogive-shaped planform.

* * * * *

UNITED STATES PATENT AND TRADEMARK OFFICE

CERTIFICATE OF CORRECTION

PATENT NO. : 7,134,230 B1
APPLICATION NO. : 10/794999
DATED : November 14, 2006
INVENTOR(S) : Boens et al.

It is certified that error appears in the above-identified patent and that said Letters Patent is hereby corrected as shown below:

Col. 1, line 24 “shinned” should read as -- shipped --

Signed and Sealed this

Fifteenth Day of May, 2007

JON W. DUDAS
*Director of the United States Patent and Trademark Office*